US006089153A

United States Patent [19]

Regele et al.

[11] Patent Number: 6,089,153

[45] Date of Patent: Jul. 18, 2000

[54] DEVICE FOR APPLYING WETTING AGENT TO A CYLINDER OF A ROTARY PRINTING MACHINE

[75] Inventors: Stephan Regele, München; Manfred Batke, Augsburg, both of Germany

[73] Assignee: MAN Roland Druckmaschinen AG, Offenbach am Main, Germany

[21] Appl. No.: 09/153,710

[22] Filed: Sep. 15, 1998

[30] Foreign Application Priority Data

Sep. 15, 1997 [DE] Germany ..... 197 40 476

[51] Int. Cl.[7] ..... B41L 25/06

[52] U.S. Cl. ..... 101/147; 101/425

[58] Field of Search ..... 101/147, 366, 101/425, 148, 424; 239/DIG. 23, 505, 507, 509, 513

[56] References Cited

U.S. PATENT DOCUMENTS

| | | | |
|---|---|---|---|
| 3,924,531 | 12/1975 | Klinger et al. | 101/147 |
| 3,990,365 | 11/1976 | Paulson | 101/147 |
| 3,992,992 | 11/1976 | Smith | 101/148 |
| 5,299,495 | 4/1994 | Schoeps et al. | 101/147 |
| 5,595,116 | 1/1997 | Ohkawara | 101/147 |
| 5,622,110 | 4/1997 | Orzechowski et al. | 101/148 |

FOREIGN PATENT DOCUMENTS

| | | |
|---|---|---|
| 0 325 381 B1 | 7/1989 | European Pat. Off. . |
| 0 525 556 | 7/1992 | European Pat. Off. . |
| 0 621 132 | 4/1994 | European Pat. Off. . |
| 571 854 | 3/1933 | Germany . |
| 864 654 | 1/1953 | Germany . |
| 872 050 | 3/1953 | Germany . |
| 24 62 162 | 3/1976 | Germany . |
| 29 31 579 C2 | 11/1982 | Germany . |
| 41 25 012 | 1/1993 | Germany . |
| 4-250039 | 9/1992 | Japan . |

*Primary Examiner*—Christopher A. Bennett
*Attorney, Agent, or Firm*—Cohen, Pontani, Lieberman & Pavane

[57] ABSTRACT

An economical device for applying a wetting agent in the form of small droplets to a cylinder includes nozzles which are supplied continuously with pressurized wetting agent arranged along the cylinder. An adjustment element in the spray area of the nozzles doses the wetting agent application that is maximally one printed page wide.

18 Claims, 5 Drawing Sheets

FIG. 3
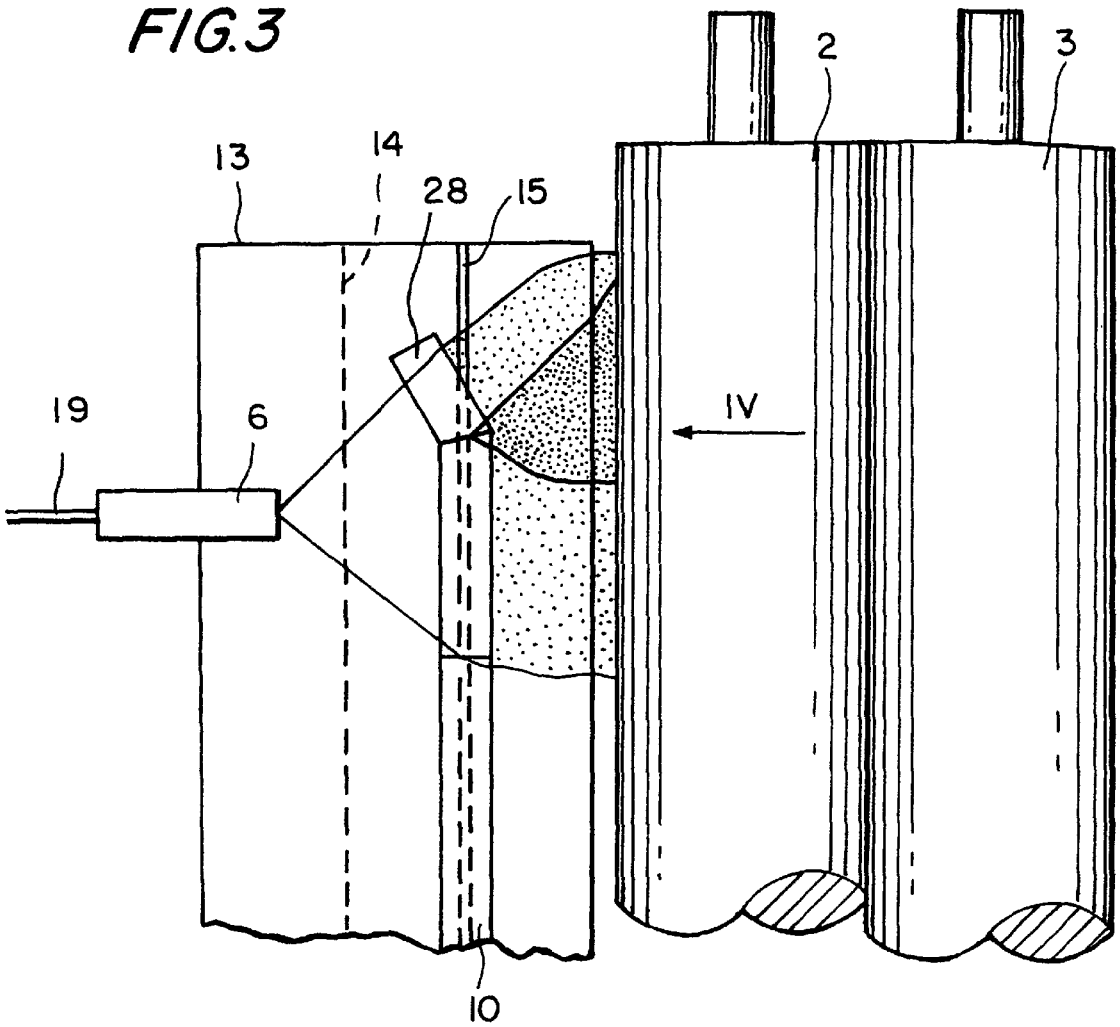
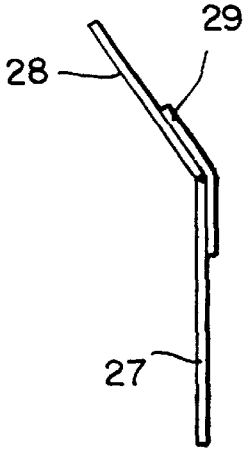
FIG. 4

FIG. 5
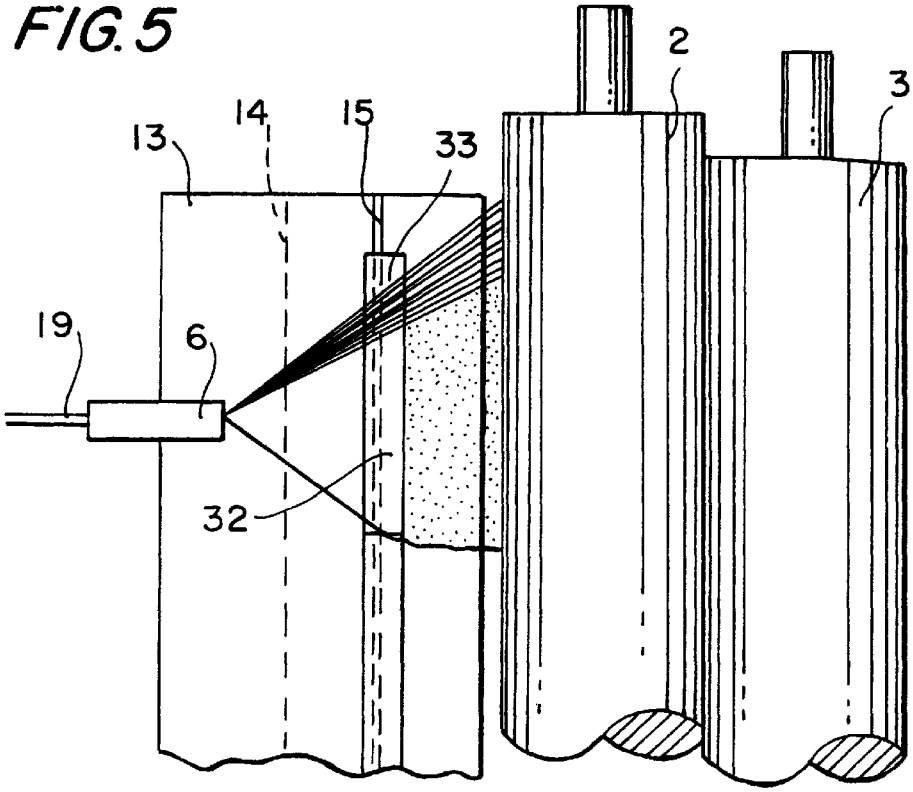
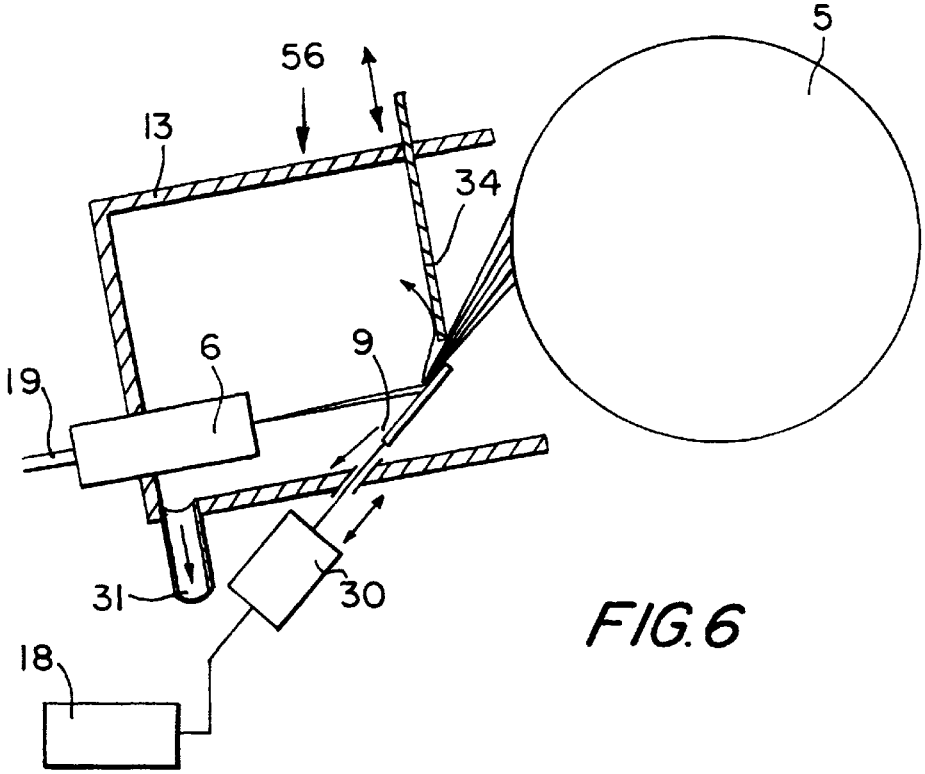
FIG. 6

DEVICE FOR APPLYING WETTING AGENT TO A CYLINDER OF A ROTARY PRINTING MACHINE

BACKGROUND OF THE INVENTION

1. Field of the Invention

The present invention relates to a device for applying wetting agent to a cylinder of a rotary printing machine.

2. Description of the Related Art

A prior art device for applying a wetting agent to a cylinder in a printing machine is disclosed in German reference DE 29 31 579 C2. In that reference, a wetting agent is applied to a cylinder of a wetting mechanism in a rotary printing machine by nozzles. The nozzles are arranged along the cylinder. To control the dispensing of emerging water relative to the machine speed, an orifice plate having a controllable opening is placed over the width of the printing form. However, a problem with this device is that the spray effects of adjacently arranged nozzles overlap, leading to fluctuations in the quality of the printed image. In addition, the drops produced are relatively large which leaves visible water marks on the printed image, despite being split and distributed in the wetting mechanism. The results are impaired quality and spoilage.

In another prior art device disclosed in Japanese reference JP 4-250 039 A, a wetting device for a rotary printing machine includes a pressurized wetting agent located in a duct box that is sprayed onto a body by nozzles. Pressurized air is blown into the duct box creating a mist which is forced through slots in the duct box wall and onto the cylinder of a wetting mechanism. The requirement of pressurized air and its associated control makes this device and its operation expensive. In addition, the use of pressurized air causes a sometimes hazardous wetting agent mist to emerge into the surrounding environment.

In yet another prior art device for wetting a cylinder disclosed in German reference DE PS 571 854, a suction nozzle operated, expensively, with pressurized air produces a jet of liquid that is repeatedly broken up on an impact plate and a reflector. The thus created mist then reaches the plate cylinder in an uncontrolled and unreliable fashion.

Furthermore, it is also common to employ the nozzles of a spray wetting mechanism for wetting agent dosing in pulse operation such, for example, as disclosed in European patent EP 0 325 381 B1. In spite of the good distribution achieved by such discontinuous application in a multi-roller wetting mechanism, the danger exists that the printing form will be unevenly inked and the print quality impaired. In addition, pulse control systems are expensive.

SUMMARY OF THE INVENTION

It is an object of the invention to provide a device for applying a wetting agent in the form of small droplets to a cylinder economically.

The object is attained according to the invention by a device for applying a wetting agent to a cylinder of a rotary printing machine having nozzles arranged along the cylinder that are continuously fed with a pressurized wetting agent for outputting a spray jet of the wetting agent. The spray jet is deflected and atomized on impact plates arranged along the cylinder. The nozzles and impact plates are located in a housing that is open toward the cylinder along with an adjustment element that is adjustable for applying a measured amount of the wetting agent that is maximally one printed page wide.

The device produces very small droplets, because the primary drops that leave the nozzles undergo a secondary breakdown upon striking the impact plates. The droplets thus created are smaller than the primary drops by one to two powers of ten. Depending on quality requirements, the small droplet size permits the number of rollers or cylinders in the wetting mechanism to be reduced or makes such rollers unnecessary so that the wetting agent may be applied directly to the form cylinder by the device. In practical terms, the droplets deflected from the impact plates may be small enough in size so that further rolling of the droplets in a wetting roller train produces no visible improvement. Furthermore, the droplets are applied more uniformly over the width of the device than in known spray wetting mechanisms for two reasons. The first reason for this is that significantly smaller droplets are produced. The second reason is that fewer droplets are produced in the area on the impact plates where the spray effects of the nozzles could overlap because the thicker film of wetting agent on the impact plate reduces atomization. Moreover, because of the small droplet size, less wetting agent accumulates in the printing ink. All told, the conditions required for improving print quality and reducing spoilage are created.

Because of its technical simplicity and low control costs, the device according to the present invention is created inexpensively and operated economically without requiring pressurized air. The continuous operation of the nozzles ensures the even application of wetting agent to a cylinder, in particular, a form cylinder, with a correspondingly positive influence on the print quality.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference characters denote similar elements throughout the several views:

FIG. 3 is a partial top view of another embodiment of the edge wetting means of the device shown in FIG. 2;

FIG. 4 is a view of the edge wetting means of FIG. 3 from direction IV as indicated in FIG. 3;

FIG. 5 is another embodiment of the edge wetting means shown in FIG. 3;

FIG. 6 is a sectional view of another embodiment of the device for applying a wetting agent shown in FIG. 1;

DETAILED DESCRIPTION OF THE PRESENTLY PREFERRED EMBODIMENTS

Figure 1:
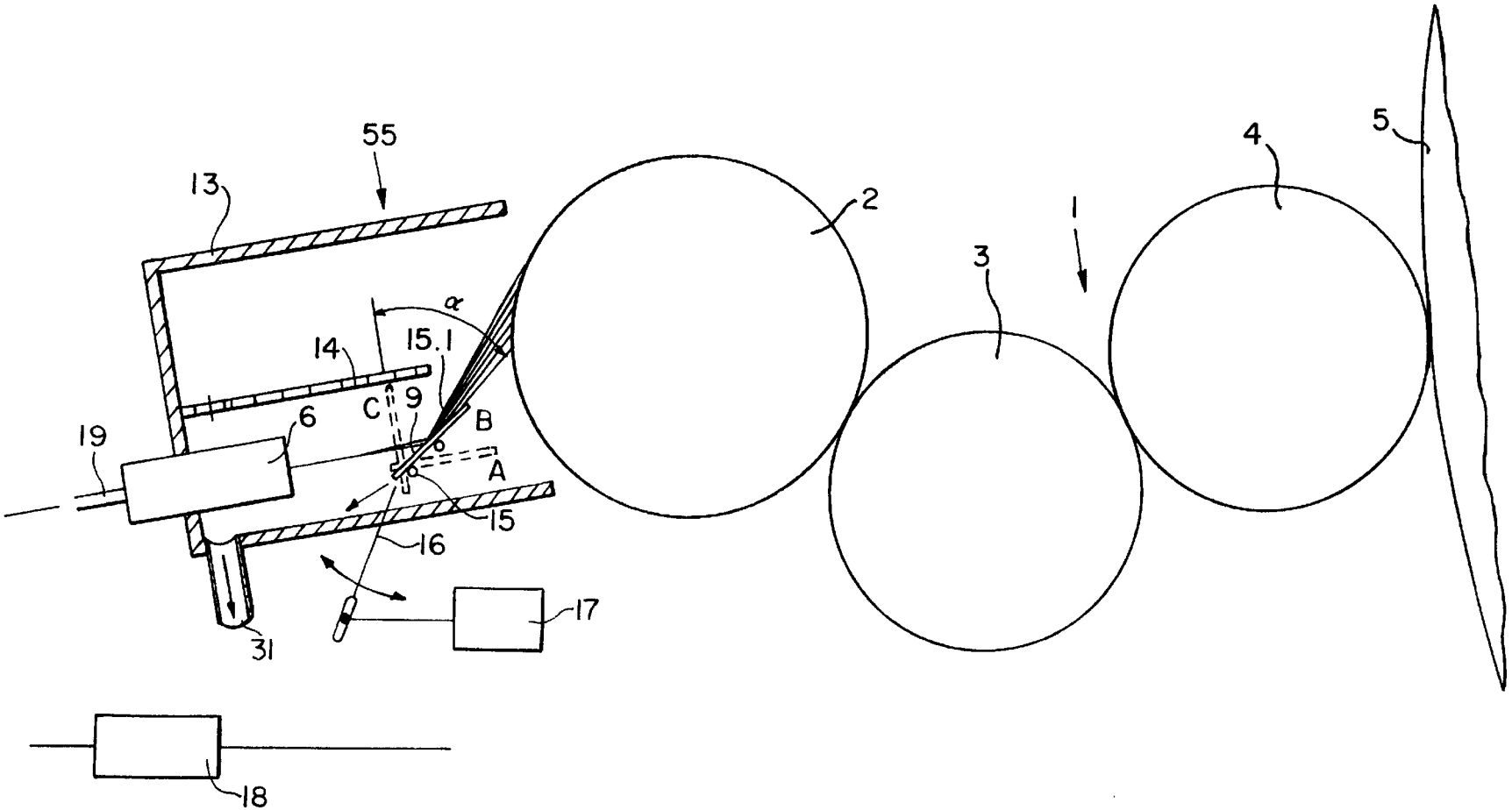
FIG. 1 is a sectional view of a device for applying a wetting agent according to an embodiment of the present invention along line I—I in FIG. 2.

FIG. 1 shows a device 55 for applying a wetting agent according to the present invention arranged on a cylinder of a wetting mechanism 1 of a rotary printing machine. In FIG. 1, the device 55 is positioned on a distributor cylinder 2, which is followed by a transfer roller 3 and a wetting agent application roller 4, which contacts the form cylinder 5. Depending on particular arrangement of the wetting mechanism 1, the device 55 for applying a wetting agent may, for example, be located on the transfer roller 3 if the distributor cylinder 2 is omitted, or on the wetting agent application roller 4 if the distributor roller 2 and transfer roller 3 are omitted. The wetting mechanism 1 may also have a different structure.

Figure 2:
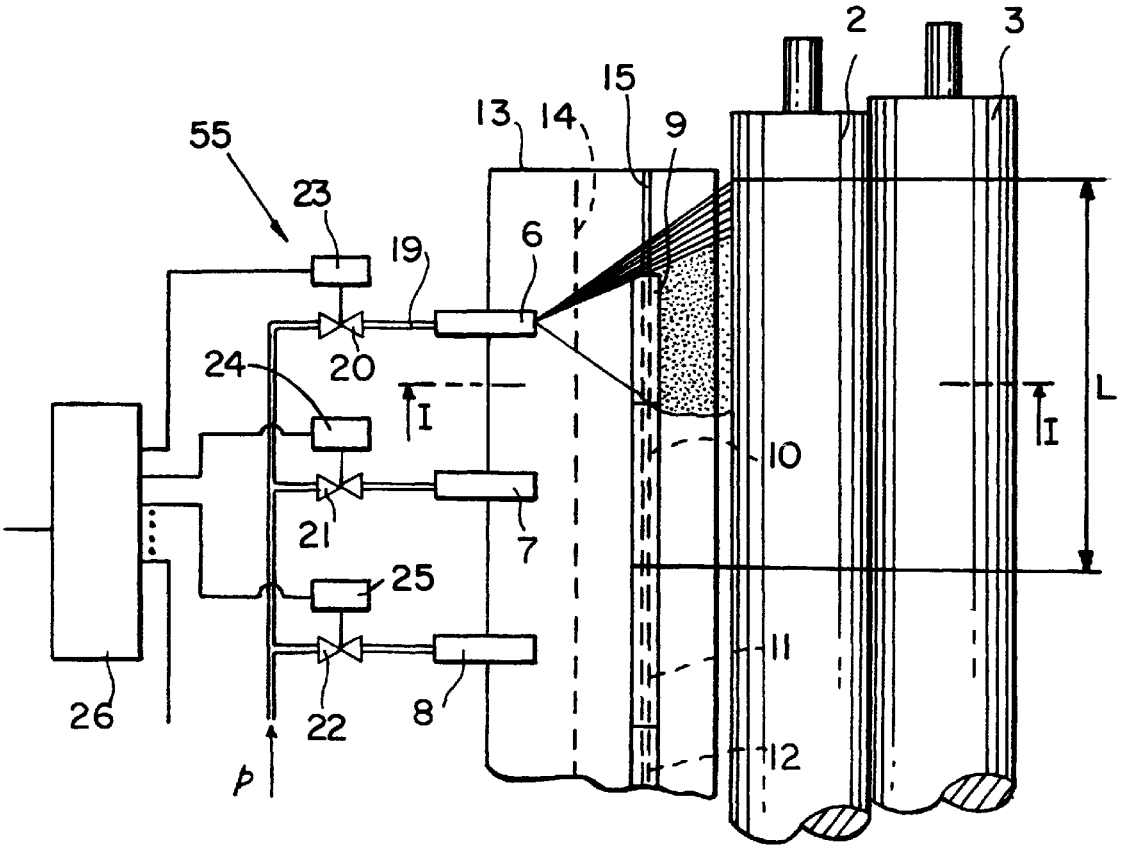
FIG. 2 is a top view of the embodiment of the device shown in FIG. 1 further showing the wetting agent supply.

Referring also to FIG. 2, the device 55 contains nozzles 6, 7 and 8 arranged along the distributor cylinder 2 to be moistened. To attain good distribution of the wetting agent along the axial direction of the distributor cylinder 2, the nozzles 6 to 8 are preferably embodied as flat spray nozzles. Such nozzles are commercially available. Impact plates 9, 10, 11, and 12 are arranged along the distributor cylinder 2 in the spray area of the nozzles 6 to 8, between the nozzles 6 to 8 and the distributor cylinder 2. The nozzles 6 to 8 as well as the impact plates 9 to 12 are oriented so that the jets sprayed from the nozzles 6 to 8 are deflected by the impact plates 9 to 12 onto the distributor cylinder 2. The nozzles 6 to 8 as well as the impact plates 9 to 12 are located in a housing 13 that is open toward the distributor cylinder 2. The nozzles 6 to 8 are fixedly attached to the housing 13. The impact plates 9 to 12 are pivotally attached to the housing about an axle 15.

In the example, there are two nozzles 6 to 8 per printed page area (the area L of one printed page is shown in FIG. 2). Each nozzle 6 to 8 is associated with a respective one of the impact plates 9 to 12. More than two or fewer than two nozzles 6 to 8 may also be used per printed page width and multiple nozzles 6 to 8 may act upon one impact plate. Furthermore, instead of two impact plates 9 to 12 per printed page width, the device 55 may be arranged with one impact plate 9 to 12 per printed page width.

The impact plates 9 to 12 are pivotally arranged on the axle 15. For producing the pivoting movement, each impact plate 9 to 12 is connected to a lever 16, which is acted upon by an adjustment element 17 as shown in FIG. 1. The adjustment element 17 may, for example, comprise an electric motor connected to a spindle drive or a linear drive or may comprise a hydraulic working cylinder. The output of a control unit 18 is connected to the adjustment element 17 for controlling the pivotable position of the impact plates 9 to 12.

A wetting agent under a pressure p is supplied to the nozzles 6 to 8 via a tubular conduit 19. A valves 20 to 22 are located in the supply lines to respective nozzles 6 to 8. Adjustment elements 23 to 25 are connected to the output of a control unit 26 shown in FIG. 2 for opening and closing the supply of wetting agent to the nozzles 6 to 8. To simplify the drawings, the adjustment elements 23 to 25 are not shown in FIG. 1 and the activation elements for the impact plates 9 to 12 are not shown in FIG. 2.

For the purpose of applying the wetting agent to the distributor cylinder 2, the wetting agent is supplied under pressure to the nozzles 6 to 8. The wetting agent sprayed from the nozzles 6 to 8 strikes the impact plates 9 to 12, whereupon the primary drops of the wetting agent produced by the nozzles 6 to 8 undergo secondary decomposition. That is the primary droplets are broken down into smaller droplets upon impacting the impact plates 9 to 12. The produced mist comprised of the smaller droplets is directed onto the distributor cylinder 2. The amount of wetting agent applied to the distributor cylinder 2 is controllably dispensed by adjustment of the positioning angle $\alpha$ of the impact plates 9 to 12 (The angle $\alpha$ is measured for position B in FIG. 1). As the angle $\alpha$ increases, the position of the impact plates 9 to 12 becomes flatter relative to the spray jet of the nozzles 6 to 8 resulting in more wetting agent reaching the distributor cylinder 2. The angle of the impact plates 9 to 12 is adjusted by activating the adjustment elements 17 by the control unit 18. The control unit 18 is attached to a control system of the printing machine.

In the illustrated arrangement, wherein the axle 15 is located outside of the spray area of the nozzles 6 to 8, the impact plates 9 to 12 may be pivoted to a position completely removed from the spray area of the nozzles 6 to 8. In this completely removed Position A of the impact plates 9 to 12, the distributor cylinder 2 is sprayed directly by the output of the spray nozzles 6 to 8, resulting in an extremely forceful application of the wetting agent. Position A may be used to over-moisten the printing form, for example, to eliminate the toning of a printing form or to allow the printing form to move freely. In Position C, the wetting agent application device is blocked from impacting the distributor cylinder 2, although the nozzles 6 to 8 may continue to be fed with wetting agent. To support this blocked Position C, the impact plates 9 to 12 advantageously interact with a deflector plate 14. In addition, the housing 13 comprises a return flow channel 31 through which the blocked wetting agent may be fed back. To assist the removal of the blocked wetting agent from the housing 13, the housing 13 is advantageously arranged with a slight downward slope toward the return flow channel 31. FIG. 1 also indicates that a second axis 15.1 may be arranged inside the spray area of the nozzles 6 to 8. When the impact plates 9 to 12 are arranged around the second axis 15.1, the impact plates 9 to 12 are not pivotable out of the spray area.

In an optional arrangement, valves 20 to 22 in FIG. 2 comprise pressure reduction valves, so that the pressure p of the wetting agent supplied to the nozzles 6 to 8 and thus the wetting agent coat is adjustable via a controlled activation of the adjustment elements 23 to 25 by the control unit 26. Moreover, all nozzles 6, 7 associated with the width L of one printed page may be fed by one valve 20, or all nozzles 6 to 8 arranged on the distributor cylinder 2 may be operated at the same optionally variable pressure p and fed by a shared tubular conduit. Adjustment element 23 to 25 may also comprise a manual adjustment for allowing the pressure to be set manually on an individual basis.

FIG. 2 also shows a mechanism for increasing the edge wetting of the distributor cylinder 2. Such an increase in the wetting agent applied, in the end, to the form cylinder may be required in printing machines when, for example, the edge regions of a form cylinder have a higher temperature because of the heating of the form cylinder bearing. In FIG. 2 the outermost impact plate 9 toward the edge of the distributor cylinder 2 extends only partially into the spray area of the associated nozzle 6. The other edge area of the distributor cylinder 2 and the other edge impact plate are not shown in FIG. 2. A part of the spray jet of the outer nozzle 6 strikes the distributor cylinder 2 directly, resulting in an increased wetting agent application. However, the droplets applied at the end are larger, so that quality impairment in the area concerned must be addressed.

Referring now to FIG. 3, a further embodiment for increasing edge wetting is shown. At the edge of the distributor cylinder 2 in FIG. 3, an edge impact plate 28 is adjustably attached to the outermost impact plate 27. For example, the edge impact plate 28 may be screwed to the impact plate 27 via a metal sheet 29 as shown in FIG. 4. Depending on the adjustment, a variable portion of the spray jet strikes the edge impact plate 28 directly from the nozzle 6, for increasing the concentration of the wetting agent mist or the coat of wetting agent on the end of the distributor cylinder 2. The slanted setting acts to focus the spray jet, as it were; the spray jet is enclosed in the edge area. The edge impact plate 28 may also be embodied, for example, as an elongated curved part of the impact plate 27.

Referring now to FIG. 5, to increase wetting of the edge of the distributor roller 2, the two outer impact plates 32 have openings 33 in the area near the edge of the distributor cylinder 2 to be moistened. In this embodiment, the wetting agent reaches the distributor cylinder 2 directly from the nozzle and thus more abundantly. In this case, before the application of the wetting agent to the printing form, oscillation should be carried out. The openings may comprise slots or holes, for example. As a further possibility or in addition to the previously described embodiments, nozzles with a higher volume may be used to increase the wetting agent coat at the edges of the distributor roller 2.

A further embodiment of the dispensing means for a wetting agent application device 56 is shown in FIG. 6. In this embodiment, a wetting agent is applied from the wetting device 56 to the form cylinder 5. The impact plates 9 are movably arranged so that they are movable out of the spray area of the nozzles 6. For this purpose, each impact plate 9 is connected to an adjustment element 30, which in turn is connected to the input of the control unit 18. In choosing the adjustment element 30, known control units may be selected, as noted in reference to the adjustment element 17, for example. The farther the impact plates 9 are moved out of the spray area of the nozzles 6 by suitable activation of the adjustment elements 30 by the control unit 26, the more wetting agent is applied to the form cylinder 5. However, quality impairment may result from the increased application of larger primary drops not atomized on the impact plate 9. Advantageously, by withdrawing the impact plates 9 from the spray area of the nozzles 6, an over-moistening of the printing form may be performed to eliminate the toning of a printing form or to allow the printing form to move freely. On the other hand, the application of the wetting agent may be completely blocked by moving the impact plates 9 completely into the spray area of the nozzles 6, advantageously, up to an orifice plate 34.

Figure 7:
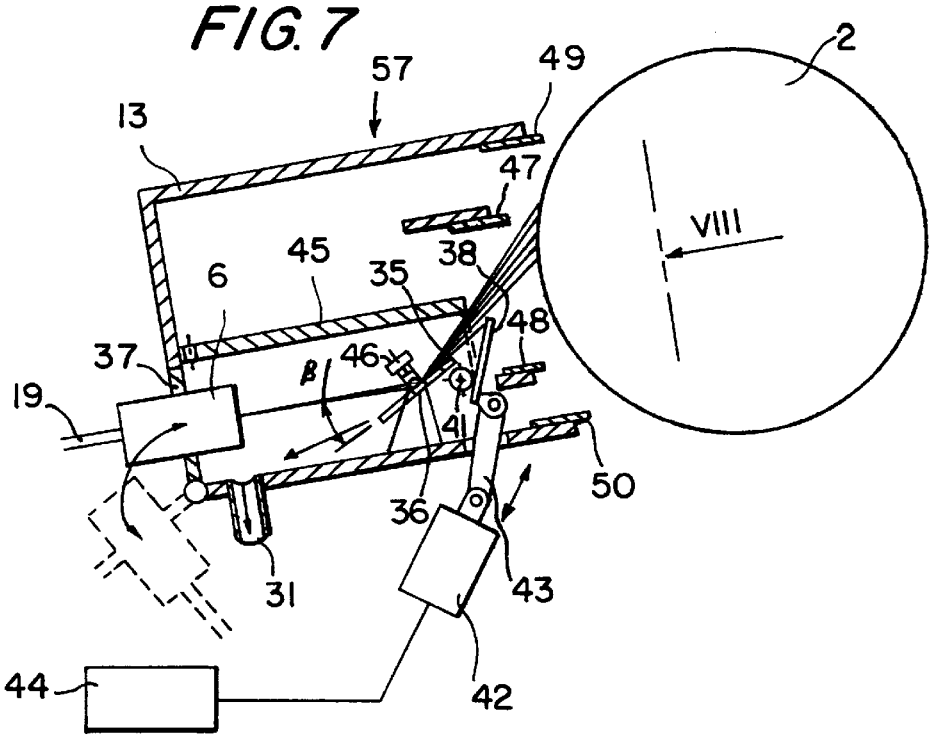
FIG. 7 is a section view of yet another embodiment of the device for applying a wetting agent shown in FIG. 1.
Figure 8:
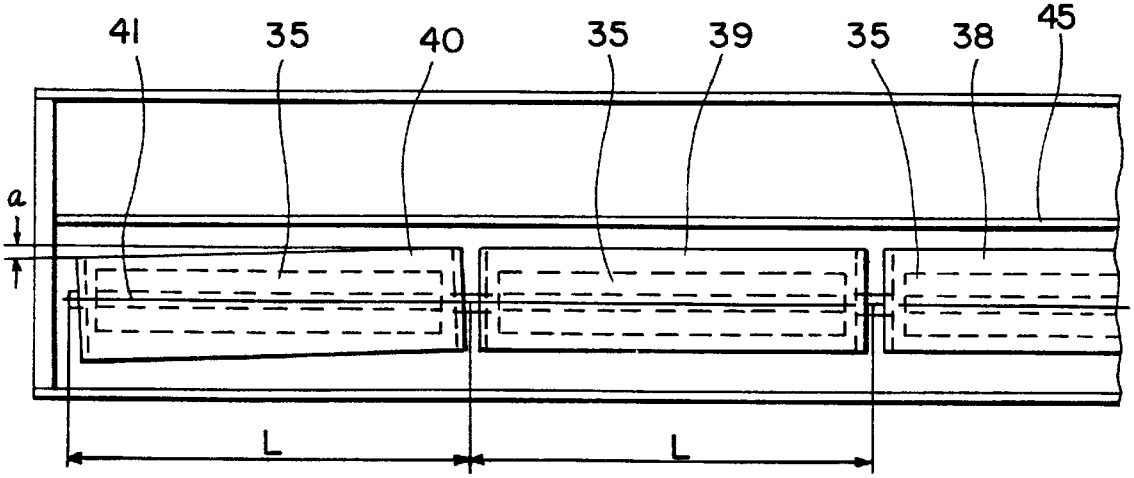
FIG. 8 is a view of the wetting device of FIG. 7 from a direction VIII as indicated in FIG. 7.

According to FIGS. 7 and 8 a device 57 for applying wetting agent contains impact plates 35 arranged along a distributor cylinder 2, each of which impact plates 35 has the width L of a printed page (printed plate width). The impact plates 35 are pivotally mounted on an axle 36 secured in the housing 13 of the device. The impact plates 35 interact with nozzles 6, such that three nozzles 6 are directed to each impact plate 35. Since each impact plate 35 covers the width of a printed page, three nozzles 6 are applied to each printed page width. The nozzles 6 are attached to a strip 37 that is pivotally mounted on the housing 13. By pivoting the strip 37, the nozzles 6 may be moved out of the housing 13 to a removed position (shown in a dashed line in FIG. 7), thereby making the nozzles 6 as well as the interior of the device (impact plates, orifice plates) accessible for maintenance work.

Orifice plates 38 to 40 are pivotally mounted in the area between the impact plates 35 and the distributor cylinder 2 on an axle 41 secured in the housing 13. To be pivoted, each orifice plate 38 to 40 is acted upon by an adjustment element 42. The adjustment element 42 may, for example, comprise an electric motor connected to a spindle drive or a linear drive or may comprise a hydraulic working cylinder. In FIG. 7, the linear-driving adjustment element 42 is connected via a coupling 43 to the orifice plate 41. The adjustment element 42 is connected to the output of a control unit 44. By adjusting the orifice plates 38 to 40, the wetting agent application on the distributor cylinder 2 may be separately dosed for each printed page. Dosing in correspondingly narrower areas is possible in an arrangement of multiple orifice plates per printed page (area L). To adjust the orifice plates 38 to 40, the adjustment element 42 is activated by the control unit 44. The adjustment may be actuated manually or in the framework of machine control, whereby the control unit 44 is connected to the control system of the printing machine. The amount of spray jet leaving the nozzles 6 and deflected by the impact plates 35 that is applied on the distributor cylinder 2 is limited depending on the setting of the orifice plates 38 to 40. According to FIG. 7, the orifice plates 38 to 40 interact with a separating wall 45 of the housing 13 and, in the position shown by the dashed line, may completely block the application of the wetting agent. Instead of orifice plates 38 to 40 shown in FIG. 7, the orifice plates may, for example, comprise partial orifice plates movable toward and away from each other. An orifice plate may also be moved in a straight line such as the orifice plate 34 shown in FIG. 6.

The impact plates 35 can be set at a selectable angle β inclined in the spray direction of the nozzles, and fixed at that position by a clamping screw 46. By setting the impact plates 35, it is possible to preselect the quantity of wetting agent to be applied.

The described embodiments of adjusting the wetting agent application device may also be used in combination. Thus, to adjust the orifice plates 38 to 40 as in FIG. 7, the motorized adjustment of the orifice plates 35 may also be provided for, as shown in FIG. 1. In addition, the pressure of the wetting agent supplied to the nozzles 6 can also be adjusted.

FIG. 8 shows another embodiment for edge over-moistening. Toward the edge of the cylinder to be moistened, each outermost orifice plate 40 is positioned less deeply into the spray area of the nozzles involved. The orifice plate 40 is screwed to the axle 41 in such a way as to be slanted by the amount a. In this embodiment, the slanted position of the orifice plate 40 trims the spray jet less toward the edge, and more wetting agent reaches the edge of the cylinder.

FIG. 7 also shows an advantageous seal of the housing 13. Here, the space containing the nozzles 6, the impact plates 35 and the orifice plates 38 to 40 is limited by sealing strips 47, 48 arranged along and at a short distance from the distributor cylinder 2. Two further sealing strips 49, 50 that act parallel to the sealing strips 47, 48 further reduce the emergence of fine residual mist from the space between the housing 13 and the distributor roller 2. The surface of the impact plates 9 to 12, 27, 28, 32 struck by wetting agent from the nozzles is advantageously embodied as a flat surface. However, surfaces that are not flat may also be used, such as convex or concave surfaces, whereby the curvatures extend at right angles to or in the longitudinal direction of the impact surfaces 9 to 12, 27, 28, 32. The impact surfaces can also be embodied with a special surface roughnesses to aid in the breakdown of the drops into smaller drops.

The invention is not limited by the embodiments described above which are presented as examples only but can be modified in various ways within the scope of protection defined by the appended patent claims.

We claim:

1. A device for applying a wetting agent to a cylinder having a width equal to an integer multiple of a predetermined printed page width in a rotary printing machine, comprising:

a nozzle operatively connected for receiving a pressurized wetting agent and outputting a spray jet directed through a spray area;

an impact plate arranged in said spray area so that said impact plate deflects and atomizes said spray jet thereby outputting a deflected spray;

a housing supporting said nozzle and said impact plate and having an open end through which said deflected spray is directed, said housing being arrangable such that said open end opens toward the cylinder; and an adjustment element arranged in said housing for dosing an application of the wetting agent, said application being directed toward an area having a width that is maximally the predetermined printed page width of the rotary printing machine.

2. The device of claim 1, wherein said adjustment element is operatively connected to said impact plate for adjusting a position of said impact plate relative to said spray area of said spray jet for dosing the application of the wetting agent.

3. The device of claim 2, wherein said position of said impact plate is adjustable to a position outside of said spray area of jet spray.

4. The device of claim 2, wherein said impact plate is pivotally mounted in said housing about a pivot axis lying within the spray area of said jet spray.

5. The device of claim 2, wherein said impact plate is pivotally mounted about a pivot axis lying outside of said spray area of said jet spray.

6. The device of claim 2, wherein said impact plate is positioned such that a portion of said jet spray directable toward an edge of the cylinder is not deflected by said impact plate, such that said jet spray imparts an increased application of the wetting agent to the edge of the cylinder.

7. The device of claim 2, wherein said impact plate comprises an edge impact plate positionable proximate an edge of the cylinder, said edge plate being operatively angularly adjustably connected to an end of said impact plate so that said edge impact plate is adjustable to a position for permitting an increased dose of the wetting agent to reach the edge of the cylinder.

8. The device of claim 2, wherein said impact plate comprises openings arrangable in an area proximate an edge of the cylinder such that an increased application of the wetting agent is applicable to the edge of the cylinder.

9. The device of claim 1, wherein said nozzle comprises a flat spray nozzle.

10. The device of claim 1, wherein said adjustment element comprises a pressure adjuster for adjusting a pressure of said wetting agent supplied to said nozzle.

11. The device of claim 1, further comprising an orifice plate operatively arranged between said impact plate and said open end of said housing for limiting the application of said wetting agent by said spray jet.

12. The device of claim 11, wherein said adjustment orifice element is operatively connected to said orifice plate for adjusting a position of said orifice plate relative to said spray area of said spray jet for dosing said application of said wetting agent.

13. The device of claim 12, wherein said orifice plate is movably mounted in said housing.

14. The device of claim 12, wherein said orifice plate is pivotally mounted in said housing.

15. The device of claim 12, wherein said orifice plate is operatively arrangable for reaching less deeply into the spray area proximate an edge of the cylinder, thereby permitting an increased application of the wetting agent proximate the edge of the cylinder.

16. The device of claim 1, wherein said nozzle is pivotally mounted on said housing such that said nozzle is pivotable to a position out of the housing for improving accessibility to said nozzle.

17. The device of claim 1, wherein said device is arrangeable on a distributor cylinder of the wetting mechanism.

18. The device of claim 1, wherein said device is arrangeable on a form cylinder the wetting mechanism.

* * * * *